United States Patent [19]

Altenbach

[11] 4,197,825

[45] Apr. 15, 1980

[54] PRIMER BULB RETAINER

[75] Inventor: Alan B. Altenbach, Cedarburg, Wis.

[73] Assignee: Tecumseh Products Company, Tecumseh, Mich.

[21] Appl. No.: 854,815

[22] Filed: Nov. 25, 1977

[51] Int. Cl.[2] ..... F02M 1/16

[52] U.S. Cl. ..... 123/187.5 R; 261/DIG. 8; 277/114; 277/189

[58] Field of Search ..... 123/187.5 R; 241/30, 241/DIG. 8; 220/319; 277/114, 188 R, 189, 190, 191 G

[56] References Cited

U.S. PATENT DOCUMENTS

| | | | |
|---|---|---|---|
| 2,379,053 | 6/1945 | Weingart | 220/319 |
| 3,103,083 | 9/1963 | Seeger | 220/319 |
| 3,170,006 | 2/1965 | Brown | 261/DIG. 68 |
| 3,275,305 | 9/1966 | Nutten | 123/187.5 R |
| 3,281,129 | 10/1966 | Payne | 123/187.5 R |
| 3,307,836 | 3/1967 | Aundt et al. | 123/187.5 R |
| 3,323,293 | 6/1967 | Santi | 123/187.5 R |
| 3,345,045 | 10/1967 | Tuggle | 123/187.5 R |
| 3,430,933 | 3/1969 | Taggart | 261/DIG. 8 |
| 3,494,343 | 2/1970 | Nutten | 123/187.5 R |
| 3,905,246 | 9/1975 | Breckenfelder | 277/189 |

*Primary Examiner*—Charles J. Myhre
*Assistant Examiner*—Andrew M. Dolinar
*Attorney, Agent, or Firm*—Albert L. Jeffers

[57] ABSTRACT

A conventional carburetor has a manually compressible bulb associated therewith which displaces air into a priming fuel well thereby forcing a priming charge of fuel into the carburetor throat. The bulb, which is formed of rubber-like material, has a central dome portion joined to an annular flange. A surface of the carburetor body has a cavity formed therein defined by a side wall and a bottom wall, the bottom wall having an annular shoulder defining an annular groove with the side wall. The bulb is positioned in the cavity with the annular flange seated in the annular groove, the dome portion thereby defining an annular slot with the side wall. An annular, spring metal sealing ring is positioned in the annular slot engaging the annular flange of the bulb, the sealing member having spaced projections thereon which frictionally engage the side wall thereby retaining the annular flange in sealing engagement with the annular groove.

10 Claims, 5 Drawing Figures

PRIMER BULB RETAINER

BACKGROUND OF THE INVENTION

1. Field of the Invention

This invention relates generally to carburetors for internal combustion engines and which include a manually compressible priming bulb for supplying a priming charge of fuel to the engine, and more particularly to a system for sealingly retaining the bulb in a member associated with the carburetor.

2. Description of the Prior Art

In application Ser. No. 854,816, assigned to the assignee of the present application, and filed on even date herewith, there is illustrated and described a carburetor which includes a body having a throat and a fuel inlet passage formed therein, a fuel reservoir, and valve means for admitting fuel from the fuel inlet to the reservoir and adapted, as by means of a float, to maintain a normal fuel level therein. The carburetor body has a portion extending into the reservoir with a second passage formed therein and orifice means for admitting fuel from the reservoir to the second passage thereby to maintain a normal fuel level therein. A fuel nozzle, having a first end in the second passage disposed below the normal fuel level and a second end in the throat, is provided for admitting fuel thereto from the second passage and reservoir. The body has a third passage formed therein communicating with the second passage above the normal fuel level, and a manually compressible bulb is provided communicating with the third passage so that compression of the bulb displaces air therefrom through the third and second passages thereby forcing a priming charge of fuel from the second passage through the nozzle into the carburetor throat.

SUMMARY OF THE INVENTION

The invention is incorporated in a carburetor of the type described and illustrated in the aforesaid application Ser. No. 854,816. In its broader aspects, the invention comprises a member having an outer surface with a cavity formed therein defined by an annular side wall and a bottom wall, the bottom wall having an annular shoulder spaced from the side wall and defining an annular groove therewith. A manually-compressible bulb has a central dome portion joined to an annular flange portion, and the bulb is positioned in the cavity with the annular flange portion seated in the annular groove whereby the dome defines an annular slot with the side wall. An annular sealing member is positioned in the annular slot engaging the annular flange portion, the sealing member having means thereon for frictionally engaging the side wall of the cavity thereby retaining the annular flange portion in sealing engagement with the annular groove.

It is accordingly an object of the invention to provide a system for sealingly retaining a manually compressible priming bulb in a member associated with a carburetor for an internal combustion engine.

Another object of the invention is to provide a system of the previous object characterized by its simplicity, effectiveness and low cost.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

Figure 1:
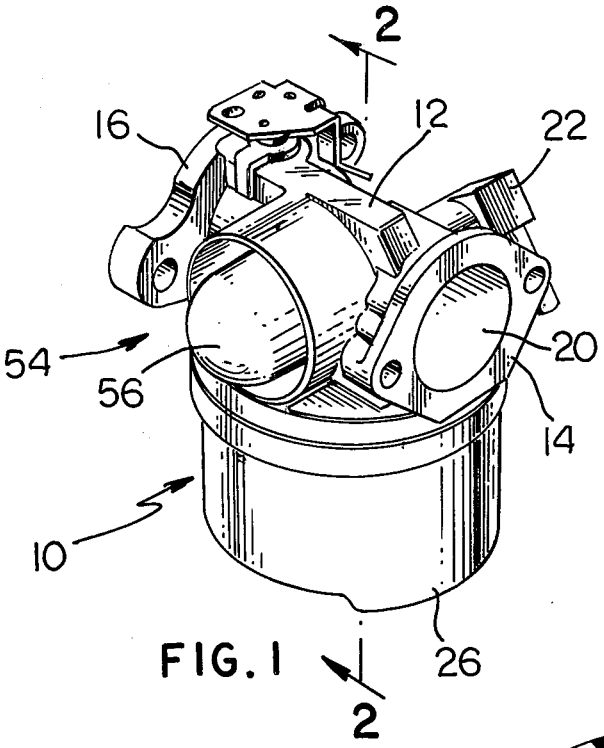
FIG. 1 is a perspective view of a carburetor for a small engine having the primer bulb retaining system of the invention directly associated therewith.
Figure 2:
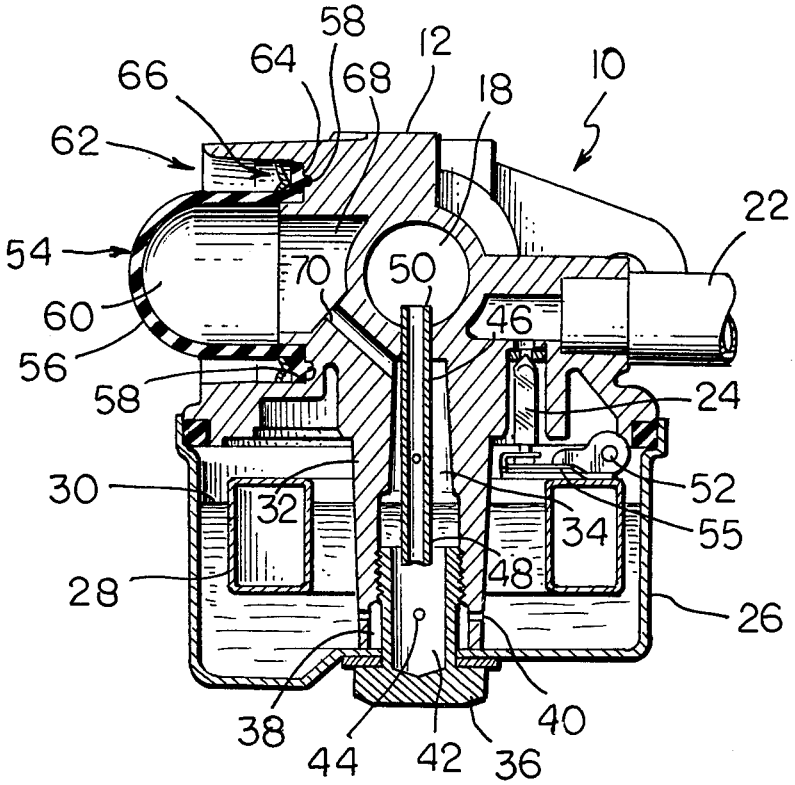
FIG. 2 is a cross-sectional view taken generally along the line 2—2 of FIG. 1.

Referring now to FIGS. 1 and 2 of the drawings, a carburetor is shown, generally indicated at 10, which provides a combustible fuel-air mixture to a conventionally aspirated small internal combustion engine (not shown), such as a lawn mower engine. Carburetor 10 includes body 12 having flange 16 adapted to be bolted directly to the engine or to an intake manifold thereof. Air is supplied to carburetor 10 from, for example, an air cleaner (not shown) bolted to flange 14 on body 12. Air passes from the air intake 20 in flange 14 through throat 18, past the usual butterfly valve (not shown) to the fuel-air discharge passage (not shown) in flange 16 and, in turn, to the engine.

Fuel is supplied to carburetor 10 by fuel line 22 by gravity flow or by way of a fuel pump (not shown) from a fuel supply tank (also not shown), and passes by way of conventional needle valve 24 to fuel bowl or reservoir 26. Annular float 28 in bowl 26 controls needle valve 24 in conventional fashion thereby to provide a normal fuel level in bowl 26, as shown at 30.

Carburetor body 12 has post 32 extending downwardly into bowl 26 and having passage 34 formed therein. Bowl 26 is removably secured to body 12 by plug 36 threaded into passage 34 of post 32. Annular passage 38 is formed between the lower end of post 32 and plug 36, and orifices 40 in post 32 communicate between bowl 26 and passage 38. Plug 36 has cavity 42 formed therein communicating with passage 34 in post 32, and one or more metering orifices 44 in plug 36 communicate between annular passage 38 and cavity 42. Thus, fuel flows slowly by gravity from bowl or reservoir 26 through orifices 40 into annular passage 38, and thence through metering orifices 44 into cavity 42 in plug 36 and passage 34 in post 32, which form a priming fuel well, where it rises to level 30.

Nozzle tube 46 is provided in passage 34 with its lower end 48 extending below normal fuel level 30 in bowl 26, and its upper end 50 extending into throat 18. It will be readily understood that when fuel level 30 in bowl 26 falls appreciably, float 28 will be pivoted downwardly about pivot pin 52 causing lever 55 to open needle valve 24 so that fuel flows from line 22 into bowl 26 to restore level 30 therein and in priming well 34, 42 whereupon float 28 actuates needle valve 24 to terminate further fuel flow.

During normal engine operation, the air flow through throat 18 past upper end 50 of nozzle 46 creates a sufficient pressure differential therein with the result that the atmospheric pressure over the fuel in bowl 26 forces the fuel upwardly through nozzle 46 and into throat 18 where it enters the air stream and is mixed therewith to provide the fuel-air mixture to the engine; however, during cranking of the engine and starting, the air flow and pressure differential is often insufficient to provide an initial change of fuel for starting and thus, it is necessary to provide some means for providing initial fuel charge, referred to as "priming".

As described in the aforesaid application Ser. No. 854,816, in order to provide the requisite priming, manually compressible bulb 54 formed of suitable rubber-like material has central dome portion 56 joined to annular flange portion 58 and forming variable volumn chamber 60. In the embodiment shown in FIG. 2, bulb 54 is positioned in cavity 62 formed in carburetor body 12 with annular flange 58 retained in sealing engagement with annular groove 64 by retainer 66 of the present invention to be hereinafter described. Interior 60 of dome 56 of bulb 54 communicates with cavity 68 in carburetor body 12 and passage 70 communicates between cavity 68 and the upper end of passage 34 above normal fuel level 30.

Figure 3:
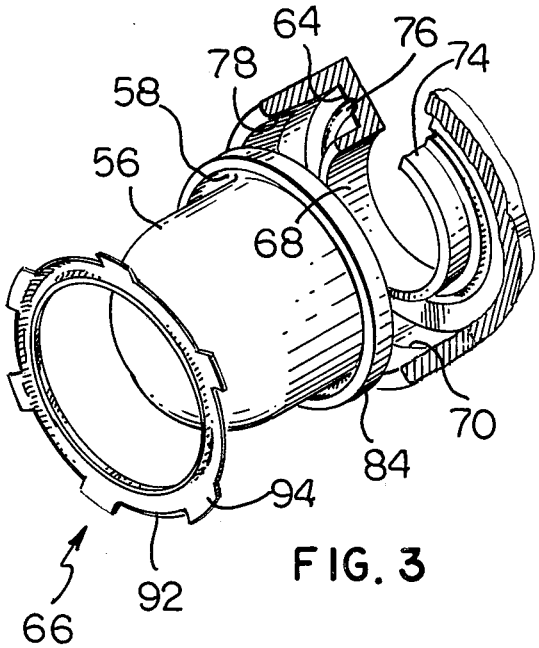
FIG. 3 is a fragmentary, exploded perspective view, partially broken away, showing the primer bulb retaining system of the invention.
Figure 4:
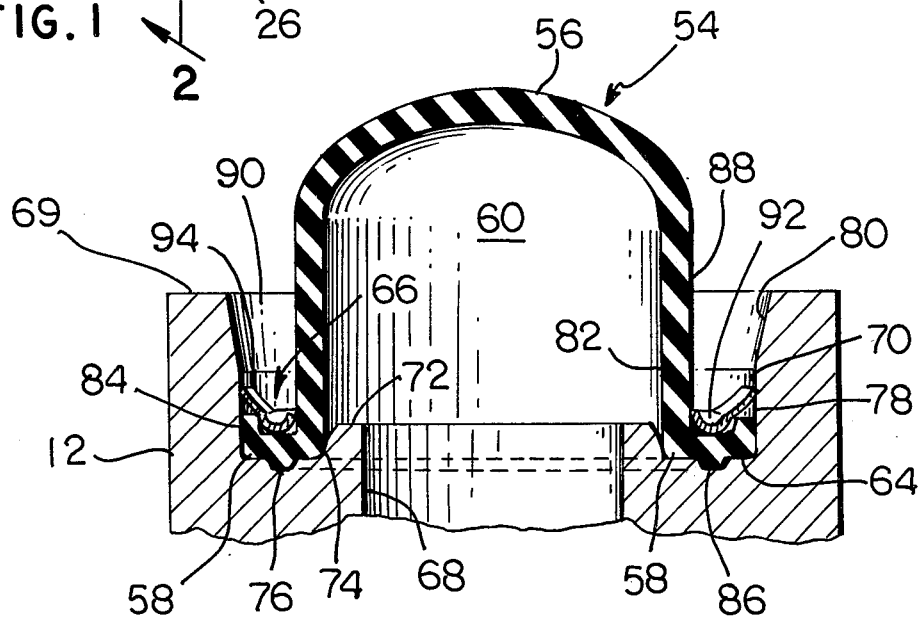
FIG. 4 is a fragmentary cross-sectional view shown of the invention.
Figure 5:
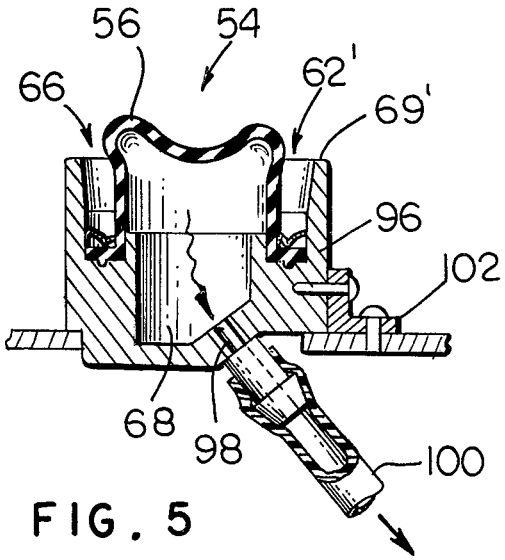
FIG. 5 is a fragmentary cross-sectional view showing the primer bulb retaining system of the invention at a location remote from the carburetor.

The natural resilience of dome portion 56 of bulb 54 causes dome 56 normally to assume the configuration shown in FIGS. 2, 3, and 4; however, dome portion 56 may be manually compressed to the configuration shown in FIG. 5 thereby to decrease the volumn of chamber 60 defined by dome portion 56. Decreasing the volumn of chamber 60 forces a portion of the air therein through passage 70 and into passage 34 thus, in turn, forcing the fuel in the fuel well comprising plug cavity 42 and the lower portion of passage 34 into the lower, immersed end 48 of nozzle 46, upwardly through nozzle 46, and out of its upper end 50 into throat 18 thereby providing a priming charge of fuel. When the manual compressive force on dome 56 is released, it returns to its normal position due to its natural resilience. A vent opening (not shown) communicates between the upper portion of passage 34 and the air intake end of throat 18 thereby permitting chamber 60 to refill with air and bulb 54 to resume its normal position without drawing fuel from fuel well 34, 42 into chamber 60.

The carburetor structure described above is not my invention, and is more fully illustrated and described in the aforesaid co-pending application Ser. No. 854,816.

Referring now more particularly to FIGS. 3 and 4 which illustrate my invention, annular cavity 62 is formed in surface 69 of carburetor body 12, being defined by annular side wall 70 and bottom wall 72. Bottom wall 72 has annular shoulder 74 spaced from side wall 70 of cavity 62 to define annular groove 64. Annular groove 64 has a smaller annular groove 76 formed in its bottom surface. A first section 78 of side wall 70 extending upwardly from annular groove 64 is cylindrical and a second section 80 extending from first section 78 to surface 68 is tapered outwardly, as shown.

Annular flange portion 58 of bulb 54 is seated in annular groove 64 with inner surface 82 of dome 56 engaging shoulder 74. Annular flange portion 58 has peripheral flange 84 which engages cylindrical side wall section 78. Annular flange 58 also has an annular projection or rib 86 formed thereon which is seated in annular groove 76. Outer surface 88 of dome portion 56 defines annular slot 90 with side wall 70 of cavity 62.

In order sealingly to retain annular flange portion 58 of bulb 54 in engagement with annular groove 64, retaining member 66 is provided comprising annular portion 92 having a plurality of spaced projections 94 extending radially outwardly therefrom. Annular portion 92 preferably has a generally U-shaped cross-sectional configuration with its convex surface engaging the annular flange portion 58, as best seen in FIG. 4. Sealing member 66 preferably is formed of suitable spring metal.

In order to assemble and seal bulb 54 in cavity 62, annular flange portion 58 is first seated in annular groove 64. Retaining member 66 is then placed over dome portion 56 and forced downwardly in annular slot 90. Projections 94 are proportioned and arranged so that, as member 66 is forced downwardly in annular slot 90, they are deflected slightly by tapered section 80 of side wall 70 with the result that when annular portion 92 is forced into engagement with annular flange portion 58, projections 94, which extend over peripheral flange 84, resiliently, frictionally engage side wall section 78 with an interference fit, thus positively retaining annular flange portion 58 in sealing engagement with annular groove 64 and positively inhibiting inadvertinent dislodgment of bulb 54 from cavity 62.

Referring now to FIG. 5 in which like elements are indicated by like reference numerals and similar elements by primed reference numerals, as pointed out in the aforesaid application Ser. No. 854,816, bulb 54 may be sealingly mounted in cavity 62' of surface 69' in member 96 remote from carburetor 10 in which case, tube 98 extends from cavity 68 and may be connected to passage 70 in body 12 of carburetor 10 by flexible tube 100. Member 96 may be mounted on the engine or in some other accessible location by means of suitable bracket assembly 102.

While there have been described above the principles of this invention in connection with specific apparatus, it is to be clearly understood that this description is made only by way of example and not as a limitation to the scope of the invention.

What is claimed is:

1. In a carburetor comprising a body having a throat and a fuel inlet passage formed therein, a fuel reservoir, valve means for admitting fuel from said fuel inlet to said reservoir, means forming a second passage communicating with said reservoir and having an end extending into said throat for admitting fuel thereto from said reservoir means forming a third passage communicating with said second passage, and a manually compressible bulb communicating with said third passage whereby compression of said bulb displaces air therefrom through said third and second passages, thereby forcing a priming charge of fuel from said second passage into said throat; the improvement comprising a member forming an integral part of said body and having an outer surface with a cavity formed therein defined by an annular side wall and a bottom wall, said bottom wall having an annular shoulder spaced from said side wall and defining an annular groove therewith, said bulb having a central dome portion joined to an annular flange portion, said bulb being positioned in said cavity with a substantial compressible portion of said bulb being surrounded by said cavity side wall so as to protect said bulb, and with said annular flange portion seated in said annular groove whereby said dome defines an annular slot with said side wall, and an annular sealing member in said annular slot engaging said annular flange portion, said sealing member having means thereon for frictionally engaging said side wall thereby retaining said annular flange portion in sealing engagement with said annular groove, said third passage communicating with the interior of said dome through said bottom wall.

2. The carburetor of claim 1 wherein said bottom wall has another cavity formed therein, said third passage communicating with said other cavity.

3. In a carburetor comprising a body having a throat and a fuel inlet passage formed therein, a fuel reservoir, valve means for admitting fuel from said fuel inlet to said reservoir, means forming a second passage communicating with said reservoir and having an end extending into said throat for admitting fuel thereto from said reservoir, means forming a third passage communicating with said second passage, and a manually compressible bulb communicating with said third passage whereby compression of said bulb displaces air therefrom through said third and second passages, thereby forcing a priming charge of fuel from said second passage into said throat; the improvement comprising a member having an outer surface with a cavity formed therein defined by an annular side wall and a bottom wall, said bottom wall having an annular shoulder spaced from said side wall and defining an annular groove therewith, said bulb having a central dome portion joined to an annular flange portion, said bulb being positioned in said cavity with said annular flange portion seated in said annular groove whereby said dome defines an annular slot with said side wall, and an annular sealing member in said annular slot engaging said annular flange portion, said sealing member having means thereon for frictionally engaging said side wall thereby retaining said annular flange portion in sealing engagement with said annular groove, said third passage communicating with the interior of said dome through said bottom wall, said annular groove having a generally flat bottom surface with annular groove formed therein, said annular flange portion having an annular projection seated in said other annular groove.

4. The carburetor of claim 1 wherein said side wall comprises a first cylindrical section extending outwardly from said annular groove and a second section which tapers outwardly from said first section to said outer surface.

5. The carburetor of claim 4 wherein said frictional engaging means comprises a plurality of spaced projections extending radially outwardly from said sealing member.

6. The carburetor of claim 5 wherein said sealing member and projections are formed of spring metal.

7. The carburetor of claim 6 wherein said sealing member has a generally U-shaped cross-section with its convex surface engaging said annular flange portion.

8. In a carburetor comprising a body having a throat and a fuel inlet passage formed therein, a fuel reservoir, valve means for admitting fuel from said fuel inlet to said reservoir, means forming a second passage communicating with said reservoir and having an end extending into said throat for admitting fuel thereto from said reservoir, means forming a third passage communicating with said second passage, and a manually compressible bulb communicating with said third passage whereby compression of said bulb displaces air therefrom through said third and second passages thereby forcing a priming charge of fuel from said second passage into said throat; the improvement comprising a member having an outer surface with a cavity formed therein defined by an annular side wall and a bottom wall, said bottom wall having an annular shoulder spaced from said side wall and defining an annular groove therein, said side wall comprising a first cylindrical section extending outwardly from said annular groove and a second section which tapers outwardly from said first section to said outer surface, said bulb having a central dome portion joined to an annular flange portion, said bulb being positioned in said cavity with said annular flange portion seated in said annular groove whereby said dome defines an annular slot with said side wall, and an annular sealing member formed of spring metal in said annular slot, said sealing member having a generally U-shaped cross-section with its convex surface engaging said annular flange portion, said sealing member having a plurality of spaced projections extending radially outwardly therefrom, said annular flange portion having a peripheral flange formed thereon engaging said side wall and defining another annular groove with said dome, said sealing member being seated in said other groove with said projections extending over said peripheral flange into frictional engagement with said side wall thereby retaining said annular flange portion in sealing engagement with said annular groove, said third passage communicating with the interior of said dome through said bottom wall.

9. In a carburetor comprising a body having a throat and a fuel inlet passage formed therein, a fuel reservoir, valve means for admitting fuel from said fuel inlet to said reservoir, means forming a second passage communicating with said reservoir and having an end extending into said throat for admitting fuel thereto from said reservoir, means forming a third passage communicating with said second passage, and a manually compressible bulb communicating with said third passage whereby compression of said bulb displaces air therefrom through said third and second passages, thereby forcing a priming charge of fuel from said second passage into said throat; the improvement comprising a member having an outer surface with a cavity formed therein defined by an annular side wall and a bottom wall, said bottom wall having an annular shoulder spaced from said side wall and defining an annular groove therewith, said bulb having a central dome portion joined to an annular flange portion, said bulb being positioned in said cavity with said annular flange portion seated in said annular groove whereby said dome defines an annular slot with said side wall, and an annular sealing member in said annular slot engaging said annular flange portion, said sealing member having means thereon for frictionally engaging said side wall thereby retaining said annular flange portion in sealing engagement with said annular groove, said bottom wall having another cavity formed therein, communicating with the interior of said dome, said third passage communicating with said other cavity, said annular groove having a generally flat bottom surface with another annular groove formed therein, said annular flange portion having an annular projection seated in said other annular groove, said bulb being formed of rubber-like material.

10. In a carburetor comprising a body having a throat and fuel inlet passage formed therein, a fuel reservoir, valve means for admitting fuel from said fuel inlet to said reservoir, means forming a second passage communicating with said reservoir and having an end extending into said throat for admitting fuel thereto from said reservoir, means forming a third passage communicating with said second passage, and a manually compressible bulb communicating with said third passage whereby compression of said bulb displaces air therefrom through said third and second passages, thereby forcing a priming charge of fuel from said second passage into said throat; the improvement comprising a member forming an integral part of said body and having an outer surface with a cavity formed therein defined by an annular side wall and a bottom wall, said bottom wall having an annular shoulder spaced from said side wall and defining an annular groove therewith, said bulb having a central dome portion joined to an annular flange portion, said bulb being positioned in said cavity with said annular flange portion seated in said annular groove whereby said dome defines an annular slot with said side wall, and an annular sealing member in said annular slot engaging said annular flange portion, said sealing member having means thereon for frictionally engaging said side wall thereby retaining said annular flange portion in sealing engagement with said annular groove, said annular sealing member including a generally U-shaped annular inner portion radially inward of said means for frictionally engaging said side wall and having an arcuate convex surface engaging said annular flange portion of said bulb, said third passage communicating with the interior of said dome through said bottom wall.

* * * * *

UNITED STATES PATENT OFFICE

CERTIFICATE OF CORRECTION

Patent No. 4,197,825 Dated April 15, 1980

Inventor(s) Alan B. Altenbach

It is certified that error appears in the above-identified patent and that said Letters Patent are hereby corrected as shown below:

Claim 1, Col. 4, Line 46, a comma should be inserted after "reservoir"

Signed and Sealed this

*Eighth* Day of *July 1980*

[SEAL]

*Attest:*

SIDNEY A. DIAMOND

*Attesting Officer*

*Commissioner of Patents and Trademarks*